US008844674B2

(12) United States Patent
Smith

(10) Patent No.: US 8,844,674 B2
(45) Date of Patent: Sep. 30, 2014

(54) ASSAULT LADDER

(76) Inventor: Collin Smith, Spanaway, WA (US)

( * ) Notice: Subject to any disclaimer, the term of this patent is extended or adjusted under 35 U.S.C. 154(b) by 179 days.

(21) Appl. No.: 13/585,386

(22) Filed: Aug. 14, 2012

(65) Prior Publication Data

US 2013/0043093 A1 Feb. 21, 2013

Related U.S. Application Data

(60) Provisional application No. 61/525,608, filed on Aug. 19, 2011.

(51) Int. Cl.
*E06C 1/00* (2006.01)
*E06C 1/38* (2006.01)

(52) U.S. Cl.
CPC ..... *E06C 1/38* (2013.01)
USPC ..... 182/21; 182/217

(58) Field of Classification Search
CPC ..... E06C 1/39; E06C 1/10; E06C 1/06; B63B 27/14; E01D 15/12
USPC ..... 182/20–22, 49, 217, 178.1, 178.2, 129; 14/69.5, 2.4
See application file for complete search history.

(56) References Cited

U.S. PATENT DOCUMENTS

| | | | | | |
|---|---|---|---|---|---|
| 891,242 | A | * | 6/1908 | Fuller | 182/194 |
| 927,491 | A | * | 7/1909 | Colborne | 182/194 |
| 1,189,514 | A | * | 7/1916 | Wallace | 182/1 |
| 1,541,422 | A | * | 6/1925 | Le Beau | 182/194 |
| 2,333,849 | A | * | 11/1943 | Driscoll | 182/21 |
| 3,016,976 | A | * | 1/1962 | Munson | 182/194 |
| 3,299,985 | A | * | 1/1967 | Harrison | 182/194 |
| 3,495,684 | A | * | 2/1970 | Homery | 182/217 |
| 3,571,909 | A | * | 3/1971 | Stern | 29/509 |
| 3,891,053 | A | * | 6/1975 | Burton | 182/97 |
| 4,053,028 | A | * | 10/1977 | Loix | 182/1 |
| 4,102,433 | A | | 7/1978 | Van Valkenburgh | |
| 4,230,202 | A | * | 10/1980 | Kudra, III | 182/45 |
| 4,448,283 | A | | 5/1984 | Marques | |
| 4,469,193 | A | | 9/1984 | Rumsey, Jr. | |
| 4,646,878 | A | | 3/1987 | Moyer | |
| 4,804,063 | A | * | 2/1989 | Farris | 182/121 |
| 4,991,690 | A | | 2/1991 | Woller | |
| 5,024,292 | A | | 6/1991 | Gilbreath et al. | |
| 5,125,476 | A | | 6/1992 | Merrick | |
| 5,279,387 | A | | 1/1994 | Swiderski et al. | |
| 5,509,499 | A | | 4/1996 | Prejean | |
| D392,744 | S | | 3/1998 | Staal | |
| 5,862,882 | A | * | 1/1999 | Brady et al. | 182/129 |
| 6,119,811 | A | | 9/2000 | Tsung-Ping | |
| 6,138,794 | A | | 10/2000 | Staal | |
| 6,142,255 | A | | 11/2000 | Plotner et al. | |

(Continued)

*Primary Examiner* — Katherine Mitchell
*Assistant Examiner* — Shiref Mekhaeil
(74) *Attorney, Agent, or Firm* — George A. Leone; Citadel Patent Law

(57) ABSTRACT

A dual-purpose assault ladder and bridging apparatus includes a right frame and a left frame both including upper and lower frame tubes. Assault steps are connected between the right and left frames. Spanning supports connect upper frame tubes. Truss brackets secure one end of an assault step to the frame elements. Assault step support tubes are located to support the assault steps. Bridging steps are connected between the right and left frames and the assault steps. A top portion is mounted at an oblique angle slanting the top portion to position the angled assault steps substantially parallel to the ground when the ladder is leaned against a wall.

8 Claims, 5 Drawing Sheets

(56) References Cited

U.S. PATENT DOCUMENTS

| | | | | |
|---|---|---|---|---|
| 6,244,383 | B1 | 6/2001 | Jung | |
| 6,364,057 | B1 | 4/2002 | Cornejo et al. | |
| 6,516,918 | B2 * | 2/2003 | Hess | 182/20 |
| 6,520,523 | B2 * | 2/2003 | Beck | 280/164.1 |
| 6,581,505 | B1 * | 6/2003 | Levell | 89/36.07 |
| 6,779,632 | B1 | 8/2004 | Parks, III | |
| 7,011,036 | B1 * | 3/2006 | Hill | 114/362 |
| 7,066,299 | B1 | 6/2006 | Fleming | |
| 7,310,842 | B2 * | 12/2007 | Frahm et al. | 14/69.5 |
| 7,370,725 | B1 * | 5/2008 | Dornfeld | 182/2.2 |
| 7,434,661 | B1 | 10/2008 | Storey | |
| 2002/0070079 | A1 | 6/2002 | Rosenwinkel | |
| 2003/0051941 | A1 | 3/2003 | Reed | |
| 2003/0183452 | A1 | 10/2003 | Montecer, Jr. | |
| 2004/0231920 | A1 | 11/2004 | Meeker | |
| 2006/0070807 | A1 | 4/2006 | Jaffe | |
| 2006/0283664 | A1 | 12/2006 | Yao | |
| 2007/0084670 | A1 | 4/2007 | Parker | |
| 2008/0210916 | A1 * | 9/2008 | Berkbuegler | 254/131 |
| 2009/0007348 | A1 * | 1/2009 | Woodmansee et al. | 14/2.4 |
| 2010/0018801 | A1 | 1/2010 | Allred et al. | |
| 2010/0133041 | A1 | 6/2010 | Wang | |
| 2010/0163340 | A1 | 7/2010 | Allred, III et al. | |
| 2010/0307870 | A1 * | 12/2010 | Zimmerman | 182/195 |
| 2011/0036666 | A1 | 2/2011 | Hong | |
| 2011/0088971 | A1 * | 4/2011 | Jaffe | 182/21 |

* cited by examiner

ASSAULT LADDER

CROSS-REFERENCE TO RELATED APPLICATIONS

This application claims the benefit of the filing date of U.S. provisional application No. 61/525,608, filed Aug. 19, 2011 to the same inventor and entitled "Assault Ladder." The contents of U.S. provisional application No. 61/525,608 are incorporated by reference.

FIELD OF THE INVENTION

The present invention relates generally to scaling apparatus and, more particularly, to a dual-purpose assault ladder that may also be used as a bridge.

TECHNICAL BACKGROUND

Ladders have been constructed for purposes of use for tactical assault and other purposes. However, such known ladders suffer from several drawbacks including difficulty in manually transporting due to weight and unwieldiness, for example. The use of standard rung designs also makes it difficult to scale such ladders in adverse conditions, such as during missions conducted in darkness. Prior designs also suffer from assembly complexity.

For example, US Patent Publication 2009/0007348, published Jan. 8, 2009, entitled, "Lightweight Modular Footbridge and Ladder," discloses a ladder with multiple pivotal connection assemblies. The ladder includes a handrail and other components including poles, pins, and cables, all requiring assembly before use. This presents a fairly high level of complexity when used in a tactical situation where quick assembly is critical.

Due to drawbacks inherent in known designs, there is a need for an improved assault ladder designed to perform multiple functions necessary for quickly moving to and assaulting targets. A lightweight, easily transportable assault ladder capable of allowing a user to climb over walls and onto roofs, as well as bridging across terrain impediments such as rivers, canals, and across gaps in roofs is needed for today's combat activities. Additionally, an improved ladder that allows connecting multiple sections to increase the length of the ladder and overcome higher obstacles is highly desirable.

The present invention overcomes drawbacks in the prior art and provides a new and novel design that solves long sought needs in the art.

SUMMARY OF THE DISCLOSURE

A dual-purpose assault ladder and bridging apparatus includes a right frame and a left frame both including upper and lower frame tubes. Assault steps are connected between the right and left frames. Spanning supports connect upper frame tubes. Truss brackets secure one end of an assault step to the frame elements. Assault step support tubes are located to support the assault steps. Bridging steps are connected between the right and left frames and the assault steps. A top portion is mounted at an oblique angle slanting the top portion to position the angled assault steps substantially parallel to the ground when the ladder is leaned against a wall.

DETAILED DESCRIPTION OF THE PREFERRED EMBODIMENTS

The examples presented herein are for the purpose of furthering an understanding of the invention. The examples are illustrative and the invention is not limited to the example embodiments. Useful applications include assault ladders for scaling walls and/or bridging gaps in combat environments.

Figure 1:
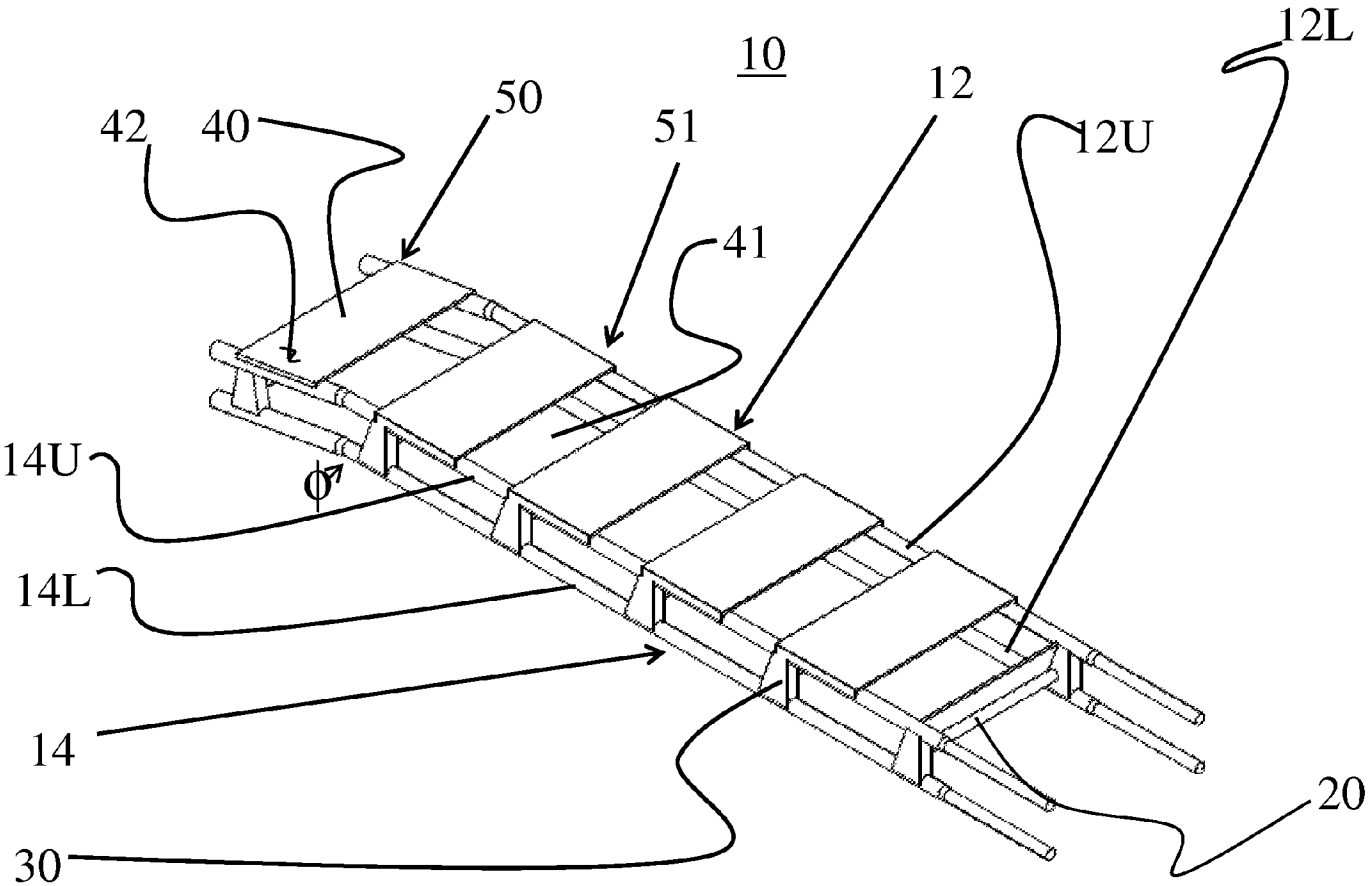
FIG. 1 schematically shows a front perspective view of an example of a dual-purpose assault ladder.

Referring now to FIG. 1 there shown is a front perspective view of an example of a dual-purpose assault ladder. A dual-purpose assault ladder and bridging apparatus (10) includes a right frame (12) including upper and lower right frame elements (12U,12L), a left frame (14) including upper and lower left frame elements (14U,14L) and a plurality of assault steps (20) connected between the right frame (12) and the left frame (14). A plurality of truss brackets (30) are mounted in pairs so that each one of the plurality of truss brackets is connected to secure one end of one of the plurality of assault steps to the upper and lower frame elements of one of either the right frame or the left frame, there being a truss bracket on each of the right and left sides of said assault step.

A plurality of bridging steps (40) are connected between the right frame (12) and the left frame (14). At least one of the plurality of bridging steps is connected to one of the plurality of assault steps (20), where the bridging step (40) has a bridging surface (42). The plane of the bridging surface (42) is mounted between and runs substantially parallel to the upper right frame element and the upper left frame element so that when placed horizontally over an obstacle like a canal the steps provide a large flat surface to safely walk across. The bridging steps (40) are sized to allow a gap (41) between the assault steps and the adjacent bridging steps to allow a foothold when the ladder is used against a wall, for example.

A top portion (50) includes at least an assault step and a pair of truss brackets, where the top portion is mounted at an oblique angle ($\phi$) slanting the top portion (50) toward the lower portion of the right frame (12) and left frame (14). In one useful embodiment, the top portion (50) further includes a bridging step (40). In one example the oblique angle ($\phi$) comprises an angle greater than 90° at the connection point between the top portion (50) and a lower ladder section (51). In another example the oblique angle may be greater than 120°. In another example the oblique angle may be greater than 170°, in yet another example the oblique angle ($\phi$) may be between about 150° and 175° with respect to the adjacent frame members.

Figure 2:
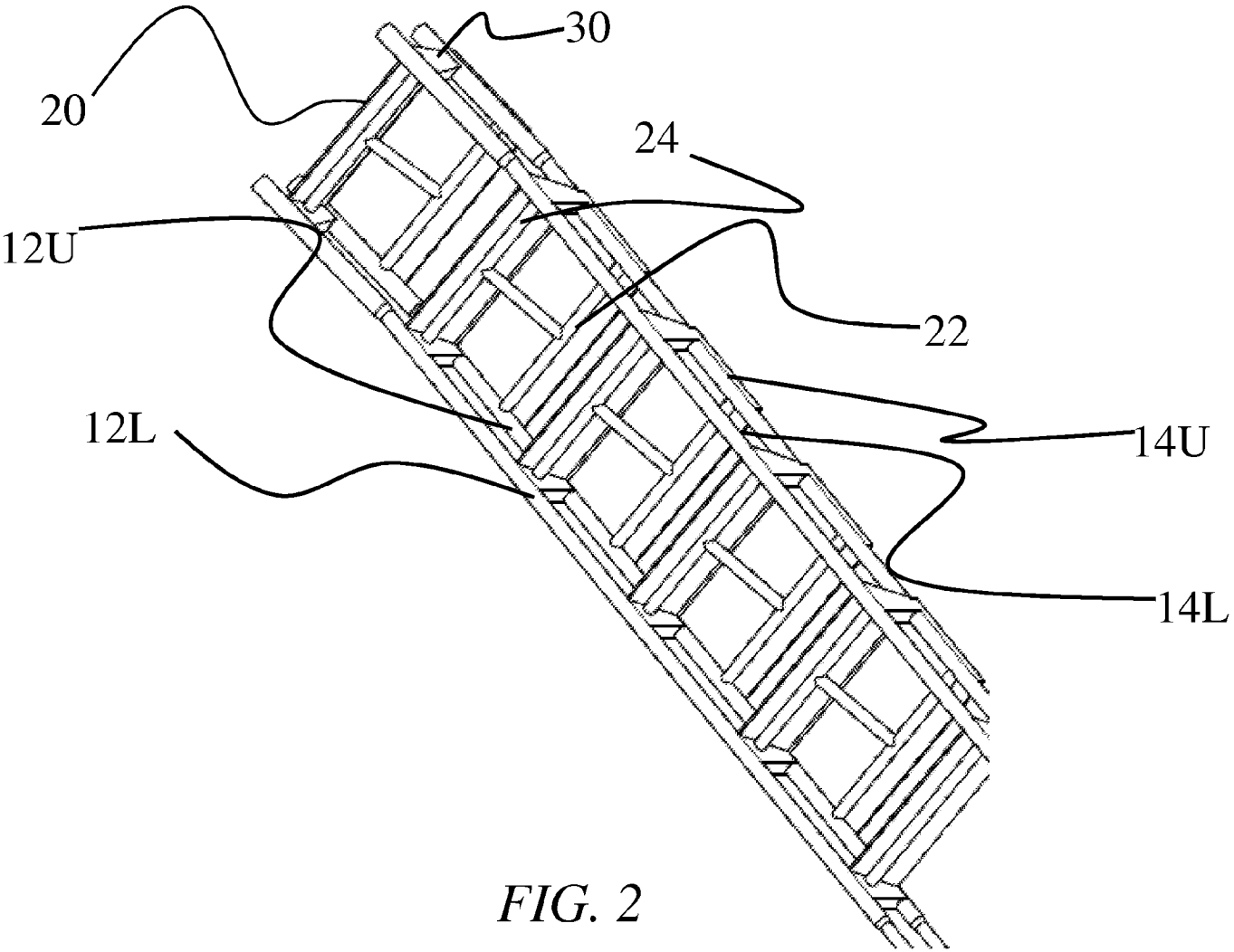
FIG. 2 schematically shows a back perspective view of an example of a dual-purpose assault ladder.

Referring now to FIG. 2 there shown is a back perspective view of an example of a dual-purpose assault ladder. A plurality of spanning supports (22) (also shown in FIG. 4) run under the bridging steps, each connecting one of the upper right frame elements (12U) with one of the upper left frame elements (14U). A plurality of assault step support elements (24) are included, where one is mounted underneath each of the assault steps (20) for supporting that assault step (20). In one useful embodiment the assault step support elements (24)

are each located to run lengthwise from right frame to left frame under the middle of an assault step and are connected between a pair of truss brackets 30.

Figure 3:
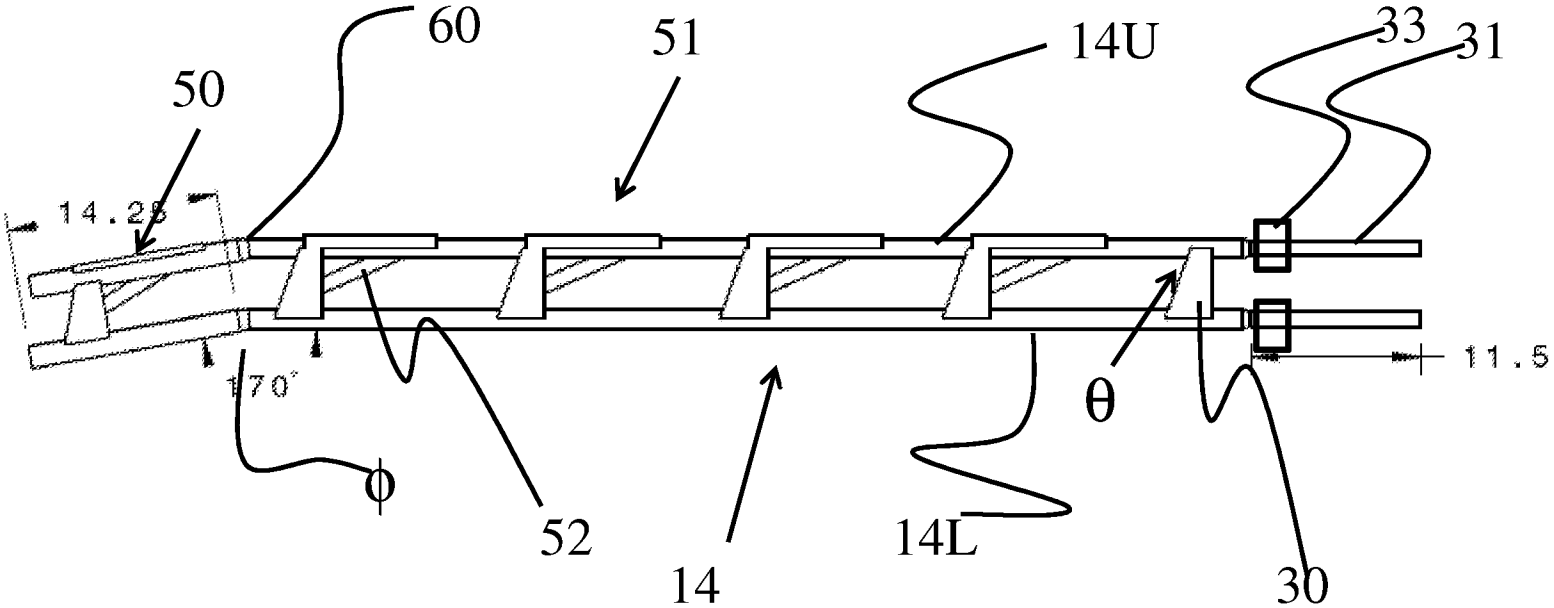
FIG. 3 schematically shows a side view of an example of a dual-purpose assault ladder.

Referring now to FIG. 3 a side view of an example of a dual-purpose assault ladder is schematically shown including a plurality of support elements (52). At least one of the support elements (52) is connected between one of the plurality of assault step support elements (24) and a lower one of the plurality of spanning supports (22). The truss brackets (30) are angled to slant each of the plurality of assault steps (20) so that the assault steps will be substantially parallel to a ground surface when placed against a vertical surface, such as a wall or fence. In one useful example, the truss brackets form an angle by tapering in width between the upper and lower frame elements. The truss, thus created, operates to support the weight of a user when used for bridging horizontal obstacles or assaulting vertical obstacles.

Bottom coupling sections 31 are sized for insertion into a ladder section 51 when coupling two or more sections together. Optionally, reinforcement elements 33, such as metal tubes or the like, may be attached to the bottom coupling sections 31 or other sections as needed to improve strength. In one example it is advantageous to cap a top end of the tubes with tubular sections (not shown) that encompass the frame tube at the ends to reduce wear on the frame and also increase strength at that point. In one example the tubes are plugged at a bottom end with a durable plug to increase durability.

Figures 4, 4A, 4B, 4C:
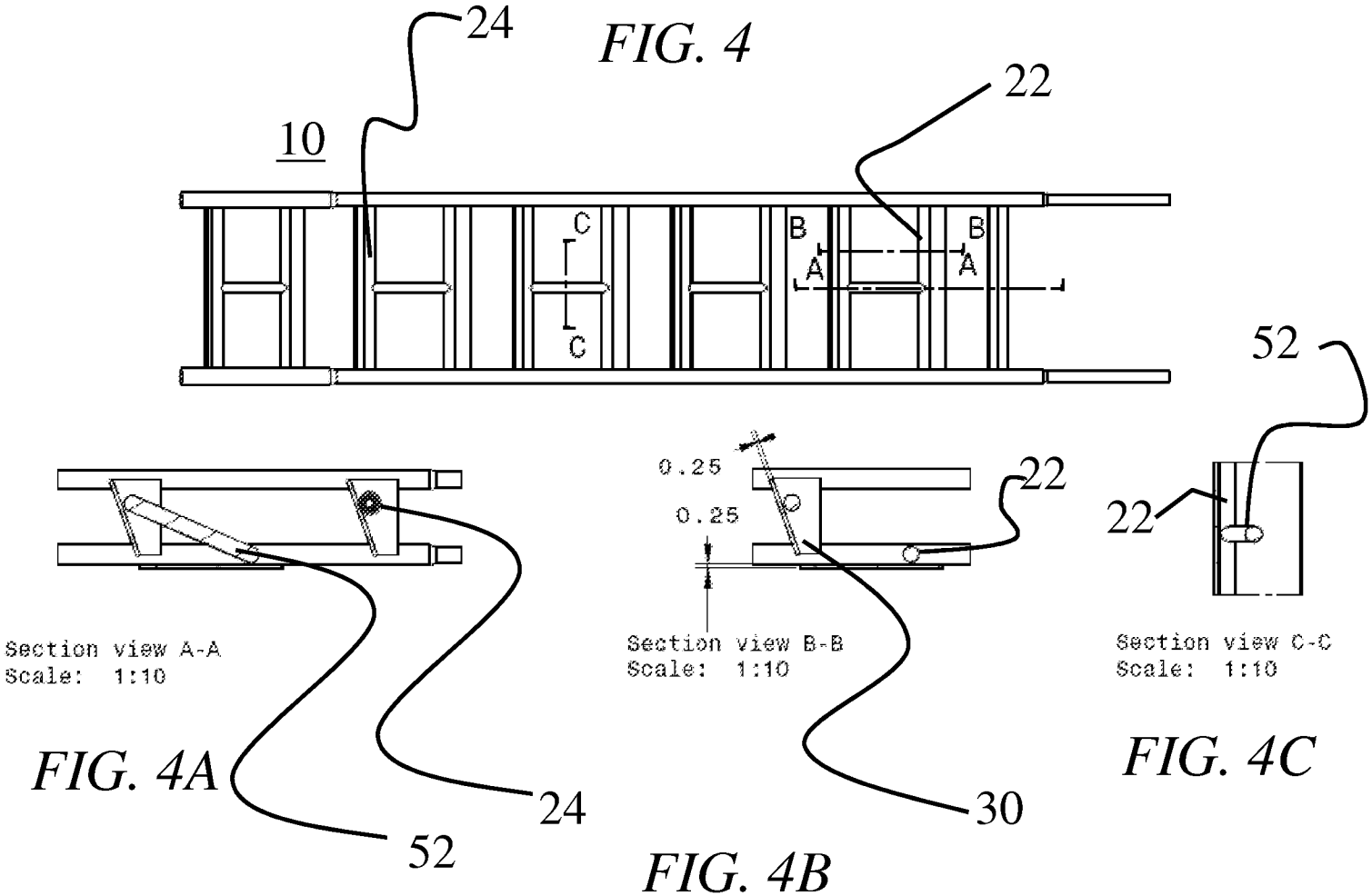
FIG. 4 schematically shows a back perspective view of an example of a dual-purpose assault ladder featuring the assault steps and truss brackets.
FIG. 4A, FIG. 4B and FIG. 4C are detailed sectional views of the assault ladder shown in FIG. 4.

Referring now to FIG. 4, there schematically shown is an example of a dual-purpose assault ladder featuring the assault steps and truss brackets. FIG. 4A, FIG. 4B and FIG. 4C are detailed sectional views of the assault ladder. FIG. 4A shows a view along section lines A-A featuring support member 52 and support 24. FIG. 4B shows a view along section lines B-B featuring truss member 30. FIG. 4C shows a view along section lines C-C featuring support member 52 and support 22.

Figure 5:
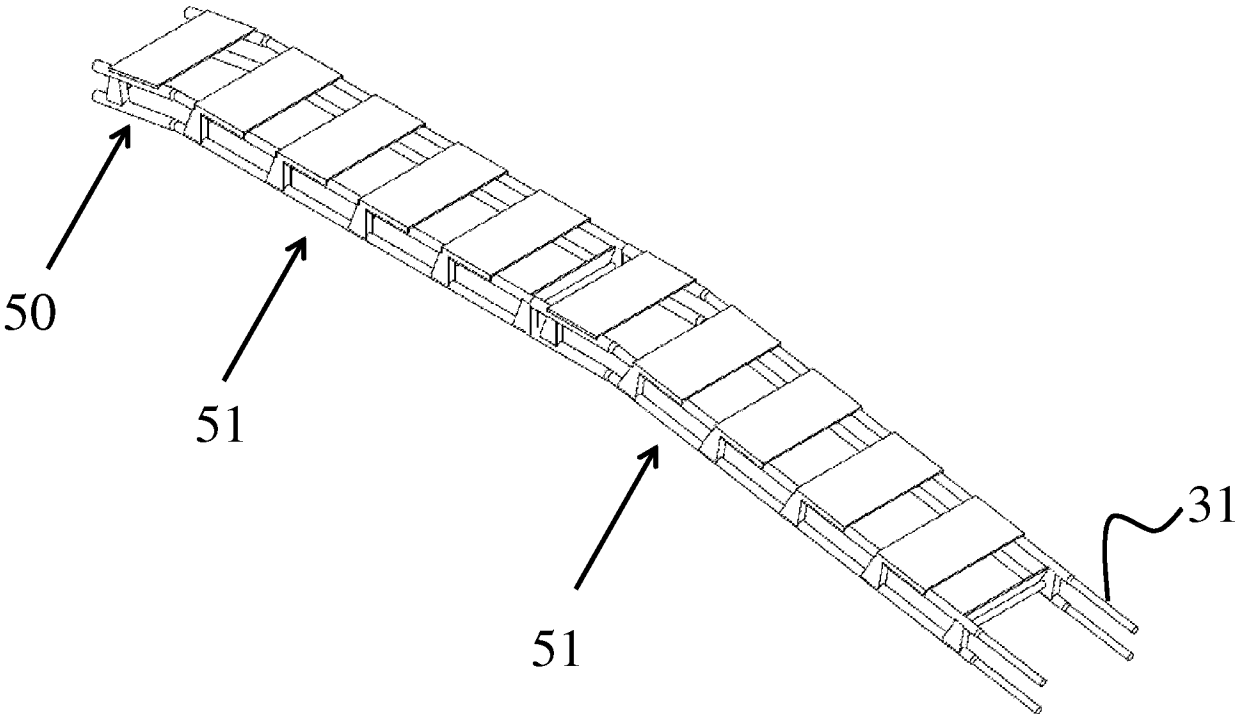
FIG. 5 schematically shows an alternate embodiment including connecting ladder sections.

Referring now to FIG. 5 there schematically shown is an alternate embodiment including connecting ladder sections. In one embodiment portions of the assault ladder comprise a top section 50 and intermediate or bottom ladder sections 51. The ends of the right frame and left frame of each section are constructed so that the inner diameter of the frame tubes at the top of the ladder are similar to the outer diameter of the tubes at the bottom end so as to allow connecting two or more sections together. In a useful example, the frame elements are fabricated as tubes with a slight bend where the tube increases in diameter to facilitate the connection of two or more sections. This bend greatly increases the strength of two or more connected sections of the ladder system when used horizontally for bridging.

Having described example structures of a new dual-use assault ladder, in certain useful embodiments, components are comprised of material selected from the group consisting of carbon fiber composites, aluminum, titanium, metal, wood, plastic, nylon and compositions thereof. In advantageous embodiments the elements, including the frames and other support elements comprise tubes fabricated from carbon fiber compositions, combinations of carbon fiber and metals, such as aluminum, titanium and the like.

Having described the structural aspects of the invention it is now considered helpful to the understanding of the invention to describe a method of fabricating a dual-use assault ladder. There are at least two construction methods that may be used depending on the base material used to build each part of the ladder. The ladder as designed can be made out of several different materials and still maintain the strength and weight necessary to be effective in all of its capacities. Some materials are more resistant to different kinds of stress and have different costs and strength to weight ratios to make them better for different parts. One example of an assault ladder was built primarily out of carbon fiber composites and the process for producing a carbon fiber model of this assault ladder will be described here.

One contemplated embodiment comprises a composite aluminum and titanium assault ladder, as well as a combination of composite carbon fiber and metals. The overall steps for producing an assault ladder are similar and presented here in order of progression.

First the individual base parts including assault step plates (formed into an assault step), frame tubes, support tubes, and truss brackets are constructed. Assault step plates can be either carbon fiber or metal. There are at least two ways a carbon fiber step plate can be made. The first is by taking a material like Nomex® aramid paper of at least ¼" thickness or a balsa base material of similar thickness and sandwiching that between two layers of carbon fiber to create a flat sheet. (Nomex® aramid paper is manufactured by E.I. Dupont de Nemours and Company, US). One layer of carbon fiber is laid straight with the weave pattern going straight along the sheet. The second layer of carbon fiber is turned 45 degrees and laid so that the fibers are cross-haired to the fibers on the sheet on the opposite side.

An alternate method includes laying the top layer of carbon fiber about 45 degrees across the top of the step. On the bottom of the step the sandwich material has 2 or more strips cut to at least 1" in width and placed perpendicular to the step to create ribs on the bottom of the step. Metal step plates can be cut to size from sheets of several different materials with various patterns cut into the sheet to reduce weight while maintaining sufficient strength. The support tubes and the mandrel tubes as described below are built identically by placing a carbon fiber sleeve around a mandrel that is removed after the carbon fiber and epoxy have dried in the desired tube shape. When building this part of the frame out of a metal component there is no need to make mandrel tubes, and the support tubes would just be cut to length most likely using a thinner wall thickness than the frame tubes.

In one example, the frame tubes have two angles and at least 3 different inner/outer diameters over their length. Carbon fiber frame tubes are built by creating several small tubes and then molding them into a single mandrel of the appropriate length. The mandrel has a taper at the bottom end that is about one foot long using a smaller diameter tube there. At the top of the frame tube mandrel a larger inner diameter tube is used to facilitate sliding the bottom end into it. This larger tube at the end of the mandrel is about 15" or 45 cm long so the bridging step plate can be flat when attached to the frame tube. This tube is also molded at an angle so that the frame tube has the bend at the top to facilitate the angling described herein. After the mandrel is molded to the proper shape and dried it is sanded and the reinforcing layers are drawn over it and it is placed in the mold for final shaping. An insert is placed inside the mold around the bottom 15" of the frame tube to ensure the outer diameter of that part of the frame tube will fit inside the top end of the frame tube again facilitating the fit.

Alternately, to make the frame tubes out of a metal or a composite formulation two pieces of the tube need to be cut and joined together. The straight section of the tube is attached by welding or jointed together with a larger tube with an inner diameter large enough to allow the outer diameter of the bottom end to slide into it. The metal frame tube will have the same dimensions and function similarly.

The truss brackets can be formed around a mold that produces a truss with an angle that facilitates the assault step plates laying flat on the frame at an angle. In one example the truss brackets are tapered to an angle that allow the assault steps to lay at an angle θ between about 65° and 75° with respect to the upper frame members (as shown in FIG. 3). In most cases the steps thus angled will be substantially parallel to the ground when the assault ladder is leaned against a vertical surface.

The support tubes are connected to the truss brackets and to the bridge step plate. One of the support tubes is placed in a hole drilled into the truss tube on each side. The support tube under the bridge step plate is centered under the plate so that it contacts the frame tubes while the step plate itself is centered over the frame tubes. If using composites, epoxy is wet laid with carbon fiber reinforcement and a mold with vices is used to compress the pieces together and promote bonding into a single piece. When using metal construction, brackets are used to fasten the pieces together. Welding can be used as reinforcement.

Once the frame tubes are complete all four must be placed in a mold that holds the ends at the right spacing and alignment and keeps the ends even. In order to facilitate the ability to attach multiple sections of the assault ladder system together it is necessary to hold the frame tubes in a static position while the trusses, support tubes, and step plates are secured to the frame.

The invention has been described herein in considerable detail in order to comply with the Patent Statutes and to provide those skilled in the art with the information needed to apply the novel principles of the present invention, and to construct and use such exemplary and specialized components as are required. However, it is to be understood that the invention may be carried out by specifically different equipment, and devices and reconstruction algorithms, and that various modifications, both as to the equipment details and operating procedures, may be accomplished without departing from the true spirit and scope of the present invention.

For example, it is contemplated that spring-loaded quick connection devices as known in the art may be incorporated into the design to allow quick assembly and locking of ladder sections. Ribbing or other types of support techniques may also be employed to support the assault or bridging surfaces.

What is claimed is:

1. A dual-purpose assault ladder and bridging apparatus comprising:

a right frame including upper and lower right frame elements;

a left frame including upper and lower left frame elements;

a plurality of assault steps connected between the right frame and the left frame;

a plurality of spanning supports, each spanning support connecting one of the upper right frame elements with one of the upper left frame elements;

a plurality of truss brackets, where one of the plurality of truss brackets is connected to secure one end of one of the plurality of assault steps to the upper and lower frame elements of one of either the right frame or the left frame, there being a truss bracket on each of the right and left sides of said assault step;

a plurality of assault step support elements, where each of the plurality of assault step support elements is located underneath one of the assault steps for supporting that assault step;

a plurality of bridging steps connected between the right frame and the left frame, at least one of the plurality of bridging steps is connected to one of the plurality of assault steps, where the at least one of the plurality of bridging steps has a bridging surface wherein the plane of the bridging surface is mounted between and runs substantially parallel to the upper right frame element and the upper left frame element while leaving a foothold gap over an adjacent assault step;

a top portion including an at least one of the plurality of assault steps and at least one pair of the plurality of truss brackets, where the top portion is mounted at an oblique angle (ø) slanting the top portion toward the lower right frame elements and the lower left frame elements; and a plurality of support elements wherein at least one of the support elements is connected between one of the plurality of assault step support elements and a lower one of the plurality of spanning supports.

2. The assault ladder of claim 1 wherein the top portion further comprises a bridging step.

3. The assault ladder of claim 1 wherein the right frame and the left frame are comprised of material selected from the group consisting of carbon fiber composites, aluminum, titanium, metal, wood, plastic, nylon and compositions thereof.

4. The assault ladder of claim 1 wherein the right frame and the left frame comprise tubes.

5. The assault ladder of claim 4 wherein a top end of the tubes are capped with tubular sections that encompass the frame tube at the ends to reduce wear on the frame and also increase strength at that point.

6. The assault ladder of claim 1 wherein each of the plurality of truss brackets form an angle by tapering in width between the upper and lower frame elements.

7. The assault ladder of claim 1 wherein the oblique angle (ø) comprises an angle greater than 90° at the connection point between the top portion and a lower ladder section.

8. A dual-purpose assault ladder and bridging apparatus (10) comprising:

a right frame including upper and lower right frame elements;

a left frame including upper and lower left frame elements;

a plurality of assault steps connected between the right frame and the left frame;

a plurality of spanning supports, each spanning support connecting one of the upper right frame elements with one of the upper left frame elements;

a plurality of truss brackets, where one of the plurality of truss brackets is connected to secure one end of one of the plurality of assault steps to the upper and lower frame elements of one of either the right frame or the left frame, there being a truss bracket on each of the right and left sides of said assault step;

a plurality of assault step support elements, where each of the plurality of assault step support elements is located underneath one of the assault steps for supporting that assault step;

a plurality of support elements wherein at least one of the support elements is connected between one of the plurality of assault step support elements and a lower closest one of the plurality of spanning supports;

a plurality of bridging steps connected between the right frame and the left frame, at least one of the plurality of bridging steps is connected to one of the plurality of assault steps, where the at least one of the plurality of bridging steps has a bridging surface wherein the plane of the bridging surface is mounted between and runs substantially parallel to the upper right frame element and the upper left frame element while leaving a foothold gap over an adjacent assault step;

a top portion comprising one of the plurality of assault steps, a bridging step and one pair of the plurality of truss brackets, where the top portion is mounted at an oblique angle (ø) between 150° and 175° with respect to the adjacent frame members; and wherein the right frame, the left frame, the plurality of assault steps, the plurality of spanning supports, the plurality of truss brackets, the plurality of assault step support elements, the plurality of support elements, the plurality of bridging steps, and the to portion are comprised of carbon fiber composites and wherein the oblique angle (ø) comprises an angle greater than 120° at the connection point between the top portion and a lower ladder section.

* * * * *